US005922111A

United States Patent [19]

Omi et al.

[11] Patent Number: 5,922,111

[45] **Date of Patent: *Jul. 13, 1999**

[54] ELECTROSTATIC PRECIPITATOR

[75] Inventors: Takashi Omi, Anjo; Takashi Tsuchiya, Aichi-ken, both of Japan

[73] Assignee: Omi Kogyo Co., Ltd., Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,626

[22] PCT Filed: May 8, 1995

[86] PCT No.: PCT/JP95/00871

§ 371 Date: Jun. 5, 1996

§ 102(e) Date: Jun. 5, 1996

[87] PCT Pub. No.: WO96/06681

PCT Pub. Date: Mar. 7, 1996

[30] Foreign Application Priority Data

Aug. 30, 1994 [JP] Japan ..... PCT/JP94/01428

[51] Int. Cl.[6] ..... B03C 3/06

[52] U.S. Cl. ..... 96/60; 55/DIG. 38; 96/65; 96/98; 96/100

[58] Field of Search ..... 96/60, 65, 96–98, 96/70, 100; 55/DIG. 38

[56] References Cited

U.S. PATENT DOCUMENTS

| | | | |
|---|---|---|---|
| 1,325,136 | 12/1919 | Bradley | 96/98 |
| 1,381,719 | 6/1921 | McGee et al. | 55/DIG. 38 |
| 1,430,246 | 9/1922 | Meredith | 55/DIG. 38 |
| 2,064,960 | 12/1936 | Thorne | 96/97 X |
| 2,853,151 | 9/1958 | Guldemond | 96/61 |
| 3,668,835 | 6/1972 | Vicard | 55/DIG. 38 |
| 3,979,189 | 9/1976 | Alskog | 55/DIG. 38 |
| 4,289,504 | 9/1981 | Scholes | 96/96 X |

FOREIGN PATENT DOCUMENTS

| | | | |
|---|---|---|---|
| 230 330 | 4/1960 | Australia | 55/DIG. 38 |
| 425274 | 2/1926 | Germany . | |
| 701416 | 1/1941 | Germany . | |
| 833 798 | 3/1952 | Germany | 55/DIG. 38 |
| 3324886A1 | 1/1985 | Germany . | |
| 45-36476 | 11/1970 | Japan . | |
| 49-76163 | 7/1974 | Japan . | |
| 51-43224 | 11/1976 | Japan . | |
| 52-27422 | 6/1977 | Japan . | |
| 53-33472 | 3/1978 | Japan . | |
| 54-15577 | 2/1979 | Japan . | |
| 62-254852 | 11/1987 | Japan . | |
| 4-187254 | 7/1992 | Japan . | |
| 714 589 | 9/1954 | United Kingdom | 96/97 |

*Primary Examiner*—Richard L. Chiesa
*Attorney, Agent, or Firm*—Jones, Tullar & Cooper,P.C.

[57] ABSTRACT

An electrostatic precipitator for removing fine particles from gas is described. The precipitator includes an array of dust collection pipes, each negatively charged and serving as an electrode. Each pipe has a pin-like positively charged discharge electrode centrally located within it. Mist-laden gas is caused to flow through the pipes and is electrostatically cleaned. A slit is formed in the pipes to permit some cleaned gas to be mixed with uncleaned gas and reintroduced into the pipes to reduce the density of the fine particles in the gas entering the pipes. The pipes may be vertically or horizontally arranged.

5 Claims, 5 Drawing Sheets

ELECTROSTATIC PRECIPITATOR

BACKGROUND OF THE INVENTION

1. Field of Invention

The present invention relates to an electrostatic precipitator. More particularly, it relates to an electrostatic precipitator for collecting a mist and the like produced when a coolant is dispersed in cutting operations of various machines such as lathes and cylindrical grinding plates.

2. Background Art

Generally, the housing of typical electrostatic precipitators for collecting a mist and the like has an upper inlet for introducing air into the housing and a lower outlet for discharging the air out of the housing. The inlet and the outlet are communicated with each other through cylindrical dust collection electrodes extending vertically within the housing. The air introduced into the housing through the inlet flows through the dust collection electrodes and is discharged from the housing through the outlet. A discharge electrode is provided within each dust collection electrode. When a voltage is applied between the dust collection electrodes and the discharge electrodes, a direct current electric field is developed therebetween. Fine particles such as those of the mist and the like in the air flowing through the dust collection electrodes are attracted to and adhere to the inner walls of the dust collection electrodes due to the influence of the direct current electric field. The fine particles are, therefore, removed from the air so that air containing fewer fine particles is discharged from the outlet.

Liquid droplets are formed when the mist adhering to the inner walls of the dust collection electrodes coalesces. The droplets then flow downward along the inner wall of each dust collection electrode due to their own weight and are drained off from the dust collection electrodes through their open bottom ends. The electrostatic precipitator thus constructed is mounted, for example, on a cutting machine and collects the mist produced thereby.

However, if the mist content of the air is high, such a conventional electrostatic precipitator is not sufficient to collect the mist while the air flows through the dust collection electrode. As such, the air may still have a significant amount of the mist when it is discharged from the outlet.

When a conventional electrostatic precipitator is mounted on a cutting machine, it may be horizontally mounted depending on the arrangement of the cutting machine. In such a case, the dust collection electrodes extend horizontally so that the droplets adhered to the inner walls of the dust collection electrodes may not be drained off from and accumulated within the dust collection electrodes.

SUMMARY OF THE INVENTION

Accordingly, it is a principal object of the present invention to provide an electrostatic precipitator that positively removes fine particles from air even if the amount of the fine particles in the gas is high.

It is another object of the present invention to provide an electrostatic precipitator that positively discharges fine particles adhering to the inner wall of a dust collection electrode from the interior of the dust collection electrode even if the dust collection electrode is arranged to extend horizontally.

DISCLOSURE OF THE INVENTION

Basically, the invention comprises an electrostatic precipitator for removing fine particles from gas. The precipitator has an inlet chamber for receiving gas containing fine particles. A discharge electrode and a dust collection electrode substantially surrounding the discharge electrode are provided such that an air space is defined between the dust collection electrode and the discharge electrode. The dust collection electrode further has an entrance opening and an exit opening such that gas is permitted to flow into the air space through the entrance opening from the inlet chamber and out of the air space through the exit opening. A voltage is provided between the discharge electrode and the dust collection electrode to create an electric field therebetween for electrostatically collecting fine particles from the gas in the airspace on the dust collection electrode. A guide passage is provided to route gas that has had fine particles removed from it by the electric field back to the inlet chamber to reduce the density of fine particles in the air flowing through the entrance opening.

In the preferred and illustrated embodiment, a secondary exit passage is provided in a wall of the dust collection electrode to communicate the air space with the guide to the guide passage to supply gas to the guide passage.

DESCRIPTION OF THE PREFERRED EMBODIMENTS

First Embodiment

A first embodiment of the present invention will now be described with reference to FIGS. 1 and 2.

Figure 1:
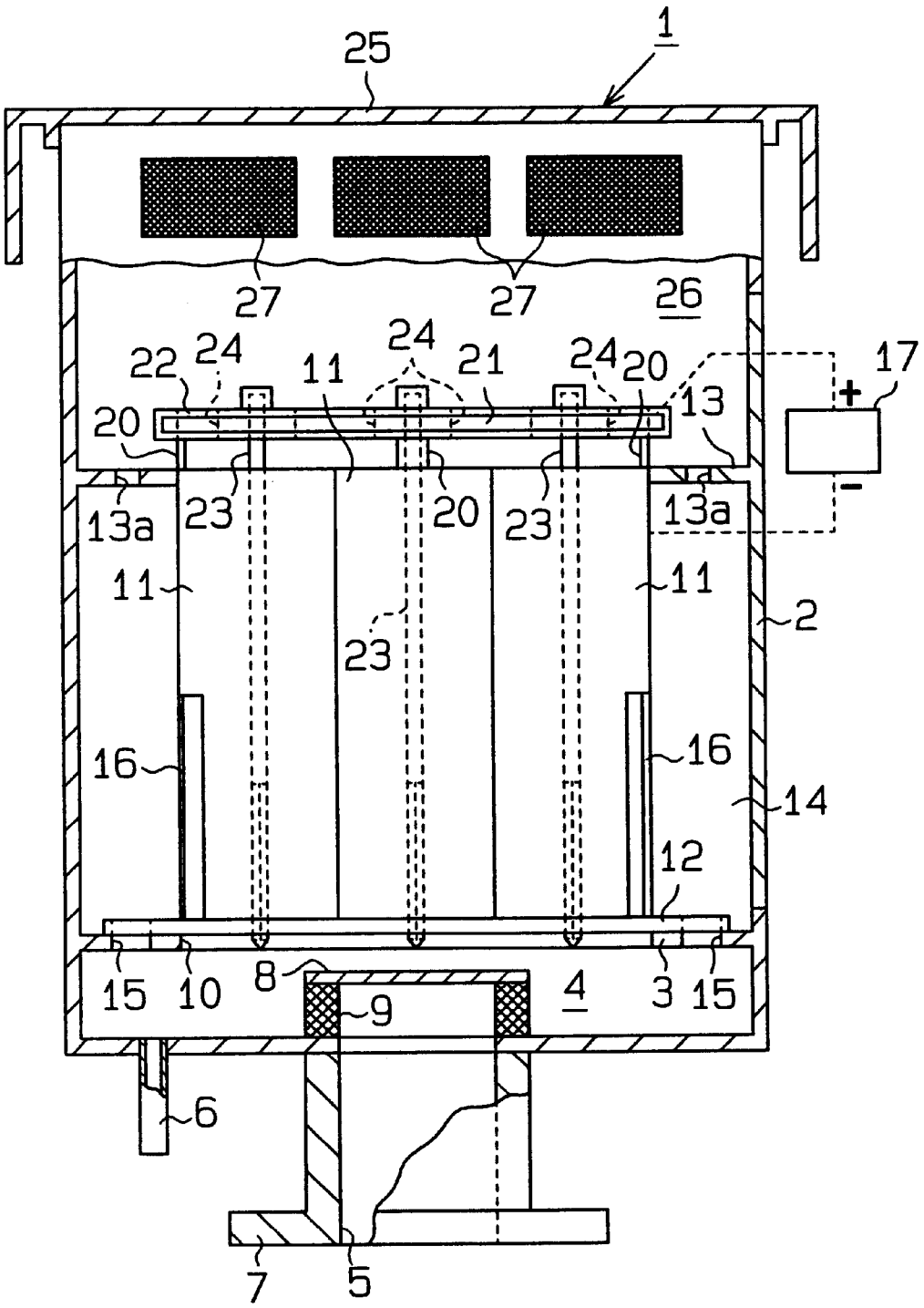
FIG. 1 is a vertical section of an electrostatic precipitator according to a first embodiment of the present invention.
Figure 2:
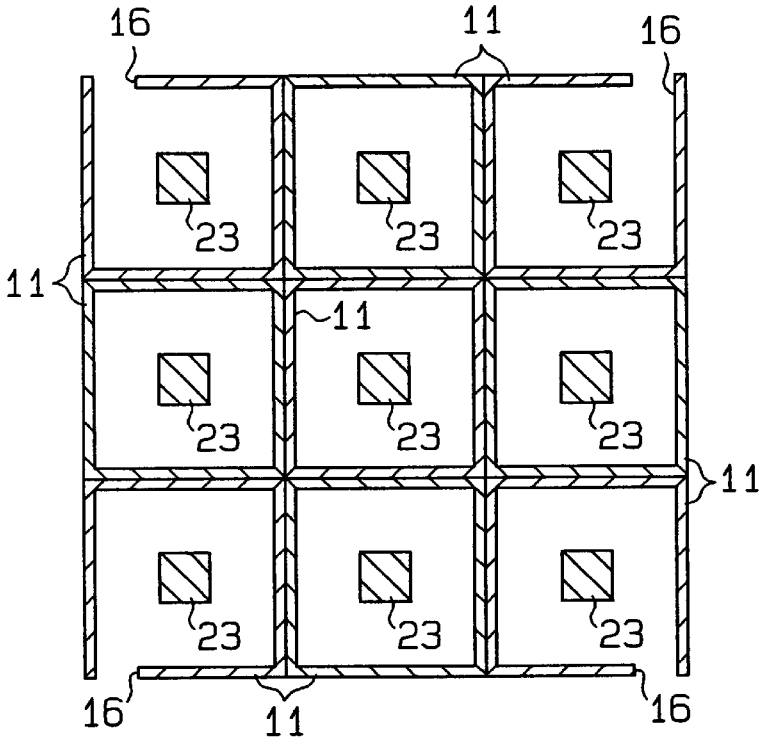
FIG. 2 is a cross section of rectangular pipes used in the first embodiment.

As shown in FIG. 1, an electrostatic precipitator 1 comprises a rectangular housing 2. A flat plate 3 extends horizontally from a lower portion of an inner wall of the housing 2. The housing 2 has an inlet chamber 4 below the flat plate 3 to receive a gas such as air containing a mist and the like. Mounted on a bottom wall of the inlet chamber 4 are an inlet 5 formed as a conduit for allowing entry of the air with the mist and the like, and a discharge port 6 also formed as a conduit for discharging the mist and the like collected by the electrostatic precipitator 1. A flange 7 is formed on a lower end of the inlet 5 to allow the electrostatic precipitator 1 to be readily mounted on various machines such as a cutting machine that produces the mist and the like.

A cylindrical dust collector 9 of a filter 8 is attached to the inlet 5 inside the inlet chamber 4. The cylindrical dust collector 9 is composed of a plurality of hollow cylinders coaxially disposed and louvered 90 degrees offset from each other. When a fan, not shown, in various machines is driven to direct air with the mist and the like from the inlet 5 to the inlet chamber 4, the air flows from inside to outside of the cylindrical dust collector 9. As a result, the cylindrical dust collector 9 will remove dust or mist particles of a relatively large diameter from the air.

The flat plate 3 has a central through-opening 10. A plurality of rectangular pipes 11 serving as dust collection electrodes are arranged to extend vertically above the through-opening 10 and are made of aluminum or other conductive material. As shown in FIGS. 1 and 2, each rectangular pipe 11 has a square cross section. The rectangular pipes (nine pipes in this embodiment) 11 are arranged into a cellular array of three vertical rows and three horizontal rows to form a lattice like pipe assembly having a square cross section and are welded to each other. At a bottom of the pipe assembly, a plate 12 is welded along a periphery of the pipe assembly. The interior of each rectangular pipe 11 communicates with the through opening 10 by securing the plate 12 on the top of the flat plate 3 via a sealing or insulating element, not shown. The rectangular pipes 11 are also connected with a power source 17 and are negatively (–) charged.

A collar 13 extends from the inner wall of the housing 2 to the pipe assembly arranged in the center of the housing 2. An inner edge of the collar 13 is secured to the upper outer surface of the pipe assembly formed of the pipes 11 via a sealing or insulating element, not shown. Below the collar 13, a guide passage 14 is defined between the housing 2 and the pipe assembly formed of the pipes 11. The guide passage 14 is communicated with the inlet chamber 4 via a plurality of guide openings 15 extending through the plate 12 and the flat plate 3. Each guide opening 15 is formed as a guiding element. Also, as shown in FIGS. 1 and 2, four vertical slits 16 or openings are formed on four corners of the pipe assembly formed of the pipes 11 to communicate the interior of the rectangular pipes 11 with the guide passage 14.

A bracket 20 is attached on top of the rectangular pipes 11. A flat anode plate 21 is secured on top of the bracket 20 and is connected to the power source 17 to be charged positively. The entire surface of the anode plate 21, including its top and bottom surfaces, is covered with an insulating layer 22 made of nylon resin or other appropriate material so that the rectangular pipes 11 and the anode plate 21 are positively insulated from each other. Electrode pins 23 serving as discharge electrodes are connected to the anode plate 21. Each electrode pin 23 extends vertically within a respective rectangular pipe 11 such that an air space exists between the pin 23 and pipe 11. The pine 23 serving as a discharge electrode surrounded by the inner walls of the rectangular pipe 11. The electrode pins 23 are positively charged, as is the anode plate 21. The anode plate 21 has a plurality of through holes 24.

When a voltage of about 10,000 volts is applied between the electrode pins 23 and the rectangular pipes 11 from the power source 17, a strong direct current electrical field is developed between the positively charged electrode pins 23 and the inner walls of the negatively charged rectangular pipes 11. The direct current electrical field produces a shower of positive ions discharged from the electrode pins 23 toward the rectangular pipes 11. Thus, when the air with the mist and the like is introduced into the rectangular pipes 11, the mist is positively charged under the influence of the positive ion shower. The mist is attracted to and moves toward the inner walls of the rectangular pipes 11 under Coulomb forces produced by the direct current electric field. The mist is electrically neutralized when it adheres to the inner walls of the rectangular pipes 11 and becomes liquid droplets. The droplets flow downward along the inner walls of the rectangular pipes 11 and are collected.

The housing 2 has an open end, not shown, above the collar 13. The open end is covered with a lid 25 to define an outlet chamber 26 above the collar 13 and the rectangular pipes 11 in the housing 2. The outlet chamber 26 is provided to discharge the air from which the mist and the like have been removed. Outlets 27 are formed on an upper portion of an outer surface of the outlet chamber 26 to allow discharge of the air cleaned by the electrostatic precipitator 1. The collar 13 has relief openings 13*a* to communicate the guide passage 14 with the outlet chamber 26. The total open area of the relief openings 13*a* for the outlet chamber 26 is smaller than that of the guide openings 15 for the inlet chamber 4.

Operation of the electrostatic precipitator 1 thus constructed will next be described.

Air with mist and the like is introduced into the inlet chamber 4 through the inlet 5 and the first filter 8. The air then flows into the rectangular pipes 11 through the through-opening 10. At this time, if a voltage is applied between the electrode pins 23 and the rectangular pipes 11, a direct current electric field is developed between the electrode pins 23 and the rectangular pipes 11. The fine particles such as those of the mist and the like are attracted and adhered to the rectangular pipes 11 under the influence of the direct current electric field. The air cleaned within the rectangular pipes 11 is then introduced into the outlet chamber 26. The air within the outlet chamber 26 is discharged from the electrostatic precipitator 1 through the outlets 27.

Part of the air from which a large portion of the mist and the like have been removed within the four rectangular pipes 11 in the corners of the pipe assembly flows into the guide passage 14 through the slits 16. The air within the guide passage 14 slowly swirls downward around the pipe assembly and is introduced into the inlet chamber 4 through the guide openings 15. Part of the air introduced into the guide passage 14 may also flow into the outlet chamber 26 through the relief openings 13*a*.

In the inlet chamber 4, the air with a very low content of the mist introduced from the guide passage 14 is mixed with the air newly introduced through the inlet 5 to decrease the mist content of the air. The air adjusted to have a low content of mist and the like is then introduced into the rectangular pipes 11. As a result, even if the content of the mist and the like in the air newly introduced through the inlet 5 is high, the air with a relatively low content of mist and the like is introduced into the rectangular pipes 11. Such adjustment of the mist content of the air allows the electrostatic precipitator 1 to positively remove the mist.

Droplets are formed on the inner walls of rectangular pipes 11 when the fine particles such as those of the mist and the like coalesce. The droplets flow downward along the inner wall of each rectangular pipe 11 due to their own weight and drop into the inlet chamber 4 through the open bottom of each rectangular pipe 11. The droplets dropped from the rectangular pipes 11 into the inlet chamber 4 are thereafter drained off from the discharge port 6 connected to the bottom wall of the inlet chamber 4.

In this embodiment, part of the air from which the mist and the like have been removed within the rectangular pipes 11 may be returned into the inlet chamber 4 through the guide passage 14 and then mixed with the air newly introduced through the inlet 5. Therefore, even if the content of the mist and the like in the air newly introduced into the inlet chamber 4 through the inlet 5 is high, it is possible to positively remove the mist and the like from the air since air with a low content of mist and the like is introduced into the rectangular pipes 11.

In this embodiment, the relief openings 13*a* communicating the guide passage 14 with the outlet chamber 26 are also provided. The total open area of the relief openings 13*a* for the outlet chamber 26 is smaller than that of the guide openings 15 for the inlet chamber 4. Therefore, the air that is not introduced into the inlet chamber 4 and remains in the guide passage 14 can escape into the outlet chamber 26 to prevent air from being left in the guide passage 14.

Second Embodiment

Figure 5:
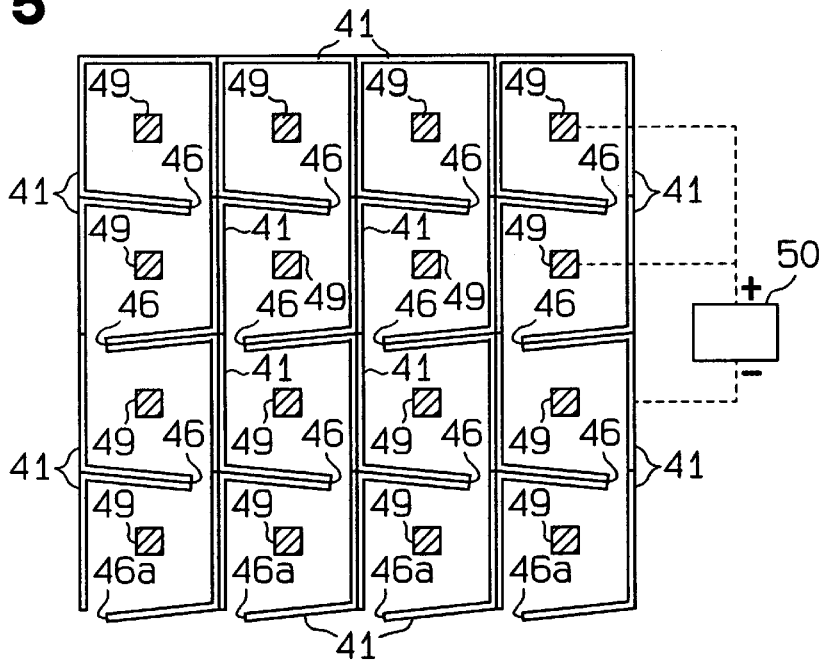
FIG. 5 is a cross section of rectangular pipes used in the second embodiment.
Figure 6:
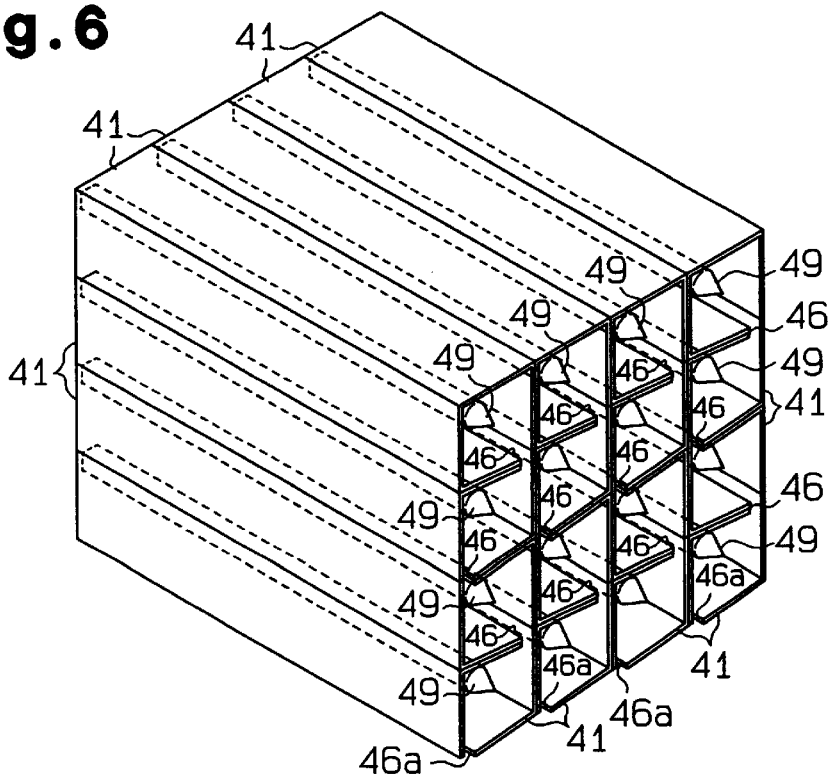
FIG. 6 is a perspective view of the rectangular pipes shown in FIG. 5.

A second embodiment of the present invention will next be described with reference to FIGS. 4 to 6.

Figure 4:
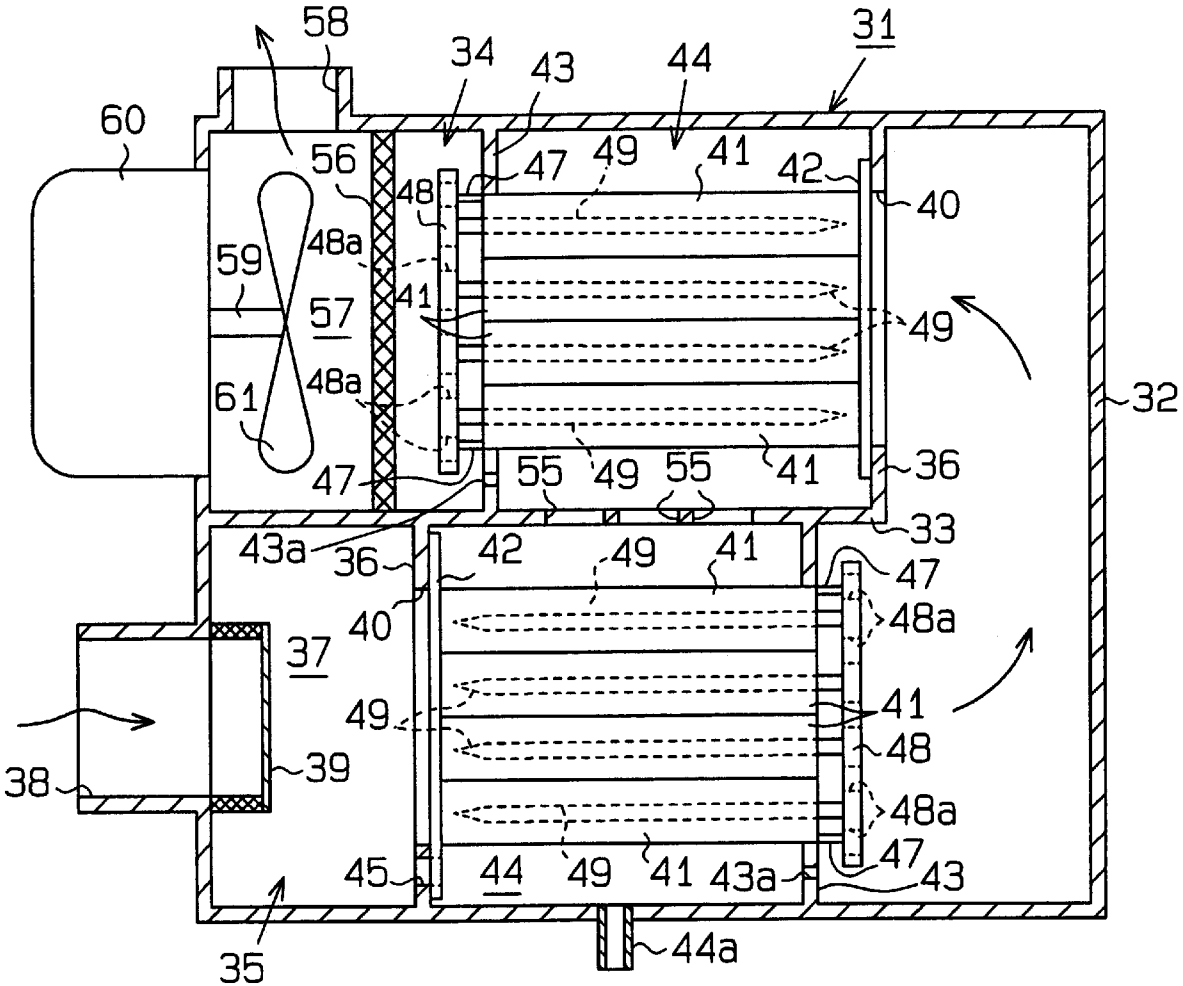
FIG. 4 is a vertical section of an electrostatic precipitator according to a second embodiment of the present invention.

As shown in FIG. 4, a housing 32 of an electrostatic precipitator 31 has a rectangular shape. The interior of the housing 32 is divided into an upper passage 34 and a lower passage 35 by a central partition 33 extending horizontally through a vertical center of the housing 32. The upper passage 34 communicates with the lower passage 35 through a space defined in the right side of the housing 32.

A vertically extending flat plate 36 is formed within the lower passage 35. An inlet chamber 37 is defined on the left side of the flat plate 36. An inlet 38 is formed in the left wall of the inlet chamber 37 to allow air with the mist and the like to flow into the inlet chamber 37. A first filter 39 is mounted at the inlet 38 inside the inlet chamber 37. The first filter 39 removes dust and mist of a relatively large diameter from the air introduced into the inlet chamber 37.

The flat plate 36 has a through-opening 40. As in the first embodiment, a plurality of rectangular pipes 41 serving as dust collecting electrodes and extending within the lower passage 35 are secured to the right surface of the flat plate 36 via a plate 42. As shown in FIGS. 4 to 6, sixteen rectangular pipes 41 are arranged and welded to each other into an array of four vertical rows and four horizontal rows to form a pipe assembly having a square cross section. Also, as shown in FIG. 4, the right end of the pipe assembly formed of the pipes 41 is secured along its outer surface to an inner edge of a collar 43 extending from an inner wall of the lower passage 35, as in the first embodiment. A guide passage 44 is horizontally defined between the collar 43 and the flat plate 36 and vertically defined between the lower passage 35 and the pipe assembly formed of the pipes 41. A guide opening 45 extends through the plate 42 and the flat plate 36 to communicate the inlet chamber 37 with the guide passage 44. The guide passage 44 also communicates with a discharge port 44*a* through which the mist and the like collected by the electrostatic precipitator 31 are drained off. Furthermore, the collar 43 has a relief opening 43*a*. The hole 43*a* allows the air remaining in the guide passage 44 to escape into the right side space in the housing 32. An open area of the relief opening 43*a* is smaller than that of the guide opening 45. As shown in FIG. 5, a slit 46 extends through each adjacent top and bottom wall of vertically adjacent rectangular pipes 41 along the entire length of the pipes 41 to vertically communicate adjacent pipes 41 with each other. Also, the pipes 41 in the lowermost row of the pipe assembly have a slit 46*a* formed like the slit 46 at its bottom wall. The slits 46*a* communicate with the guide passage 44. The slits 46 providing communication between the vertically adjacent rectangular pipes 41 are formed alternately on either right or left corner of the rectangular pipes 41 in a column of the pipes 41. Each bottom wall of the rectangular pipe 41 extends obliquely downward toward the slit 46 or 46*a*.

As shown in FIG. 4, an anode plate 48 is secured to the right ends of the rectangular pipes 41 via a bracket 47. An electrode pin 49 serving as a discharge electrode is connected to the anode plate 48 and extends horizontally within each rectangular pipe 41. The anode plate 48 also has a plurality of through holes 48*a*. As shown in FIG. 5, the rectangular pipes 41 and the electrode pins 49 are connected with a power source 50. When a voltage is applied between the rectangular pipes 41 and the electrode pins 49, the rectangular pipes 41 are negatively charged while the electrode pins 49 are positively charged.

The rectangular pipes 41, the anode plate 48, the electrode pins 49, and the guide passage 44 are also provided within the upper passage 34. These elements are given like reference numerals as those like elements provided in the lower passage 35 and will not be described since their structures and arrangements are similar to those in the lower passage 35.

Within the housing 32, a plurality of through openings 55 are formed on part of the partition 33 facing both the guide passage 44 of the upper passage 34 and the guide passage 44 of the lower passage 35 to communicate these guide passages 44 with each other. Furthermore, the collar 43 of the upper passage 34 has a relief opening 43*a*, wherein an open area of the relief opening 43*a* is smaller than that of the guide opening 45. A second filter 56 is mounted within the upper passage 34 on the left side of the anode plate 48 to remove odors from the air passing through the lower passage 35 and the upper passage 34.

An outlet chamber 57 is defined within the upper passage 34 on the left side of the second filter 56. An outlet 58 is formed at the outlet chamber 57 to discharge the air from the outlet chamber 57. A fan 60 is mounted on the left wall of the outlet chamber 57. A propeller 61 is mounted on an output shaft 59 of the fan 60 within the outlet chamber 57. The air cleaned by the electrostatic precipitator 31 is discharged from the outlet chamber 57 through the outlet 58 when the fan 60 is driven. At the same time, the fan 60 also provides a negative pressure in the lower passage 35 to draw the air with the mist and the like into the inlet chamber 37 through the inlet 38.

The operation of the electrostatic precipitator 31 thus constructed will next be described.

When the fan 60 is driven to rotate the propeller 61, the air with the mist and the like is drawn into the inlet chamber 37 through the inlet 38. The air drawn into the inlet chamber 37 flows into the outlet chamber 57 through the rectangular pipes 41 of the lower passage 35 and the rectangular pipes 41 of the upper passage 34. A direct current electric field is developed between the electrode pins 49 and the rectangular pipes 41 by applying a voltage between the electrode pins 49 and the rectangular pipes 41 when the air with the mist and the like passes through the rectangular pipes 41. Fine particles such as those of the mist and the like in the air are attracted to and adhere to the inner walls of the rectangular pipes 41. As a result, the cleaned air is drawn into the outlet chamber 57 and discharged from the electrostatic precipitator 31 through the outlet 58.

Part of the air from which the mist and the like have been removed within each rectangular pipe 41 of the upper passage 34 is introduced into the inlet chamber 37 through the slits 46 and 46*a*, the guide passage 44 of the upper passage 34, through openings 55, the guide passage 44 of the lower passage 35, and the guide openings 45. Also, the air in the guide passage 44 of the upper passage 34 which is not directed toward the inlet chamber 37 may escape into the outlet chamber 57 through the relief opening 43*a* of the upper passage 34. Furthermore, part of the air from which the mist and the like have been removed within rectangular pipes 41 of the lower passage 35 is introduced into the inlet chamber 37 through the slits 46 and 46*a*, the guide passage 44 of the lower passage 35 and the guide openings 45. The air in the guide passage 44 of the lower passage 35 that is not introduced into the inlet chamber 37 may escape into the right side space of the housing 32 through the relief opening 43*a*.

Within the inlet chamber 37, the air from which the mist and the like have been removed is mixed with the air introduced through the inlet 38. As a result, the content of the mist and the like in the air within the inlet chamber 37 is reduced to provide air with a low content of the mist and the like into the rectangular pipes 41 of the lower passage 35 and of the upper passage 34 as in the first embodiment.

Also, interference between the direct current electric fields is reduced since the slits 46 and 46*a* are formed at the corner of each rectangular pipe 41 to prevent deterioration in the dust collectability. In addition, the amount of the direct current electric field leaking from the slits 46 and 46*a* is reduced by arranging the slits 46 and 46*a* alternately on either right or left corner of each rectangular pipe 41.

The fine particles such as those of the mist and the like adhered to the inner walls of rectangular pipes 41 coalesce to form droplets. The droplets flow downward due to their own weight and are collected on an inner bottom wall of each rectangular pipe 41. The inner bottom wall of each rectangular pipe 41 extends obliquely downward toward the slit 46 or 46*a* so that the droplets approaching on the inner bottom wall of the rectangular pipe 41 flow along the slanted bottom wall toward the slits 46 or 46*a*. Thus, the droplets in each rectangular pipe 41 subsequently flow into another rectangular pipe 41 just beneath it through the slit 46. The droplets then drop through the slits 46*a* of the rectangular pipes 41 arranged in the lowermost row of the pipe assembly to be effectively collected within the guide passage 44.

As described above, in accordance with this embodiment, the slits 46 and 46*a* of the rectangular pipes 41 serve to direct part of the cleaned air into the guide passage 44 as well as to drain the droplets out of the rectangular pipes 41. Therefore, the droplets are prevented from staying within the rectangular pipes 41 though the rectangular pipes 41 are arranged to extend horizontally. If the droplets remain so as to cover the inner walls of the rectangular pipes 41, the electric dust collectability may deteriorate. In accordance with the invention, the deterioration in the electric dust collectability caused by accumulation of the droplets within the rectangular pipes 41 is prevented so that the electric dust collectability of the electrostatic precipitator is improved. Also, the droplets in the rectangular pipes 41 are efficiently drained off without a need of forming discharge holes in the rectangular pipes 41 because the slits 46 and 46*a* extend in the same direction as that of the rectangular pipes 41. Also, the droplets are more efficiently drained off from the rectangular pipes 41 since the inner bottom walls of the pipes 41 are inclined downward toward the slits 46 and 46*a*.

Furthermore, in accordance with this embodiment, the slits 46 are formed at corners of the rectangular pipes 41 superposed one above the other. It is thus possible to reduce interference of the direct current electric fields between the rectangular pipes 41 and prevent deterioration in the dust collectability. In addition, as the slits 46 extends alternately on either right or left corner of the rectangular pipes 41 in the column of the pipes 41, it is possible to reduce leakage of the direct current electric field from the rectangular pipes 41 through the slits 46 and to thus more positively prevent deterioration in the dust collectability.

Additionally, part of the air cleaned within the rectangular pipes 41 returns to the inlet chamber 37 via the guide passage 44, as in the first embodiment. It is thus possible to positively remove a substantial portion of the mist and the like from the air even if the air containing much more mist and the like is introduced into the inlet chamber 37 through the inlet 38. Also, the air in the guide passages 44 of the lower passage 35 and of the upper passage 34 is prevented from staying there since the air remaining in these guide passages 44 flows respectively into the right side space of the housing 32 and the outlet chamber 57 through the respective relief openings 43*a* of the lower passage 35 and of the upper passage 34.

The present invention is not limited to the foregoing embodiments and may be modified as follows.

Figure 3:
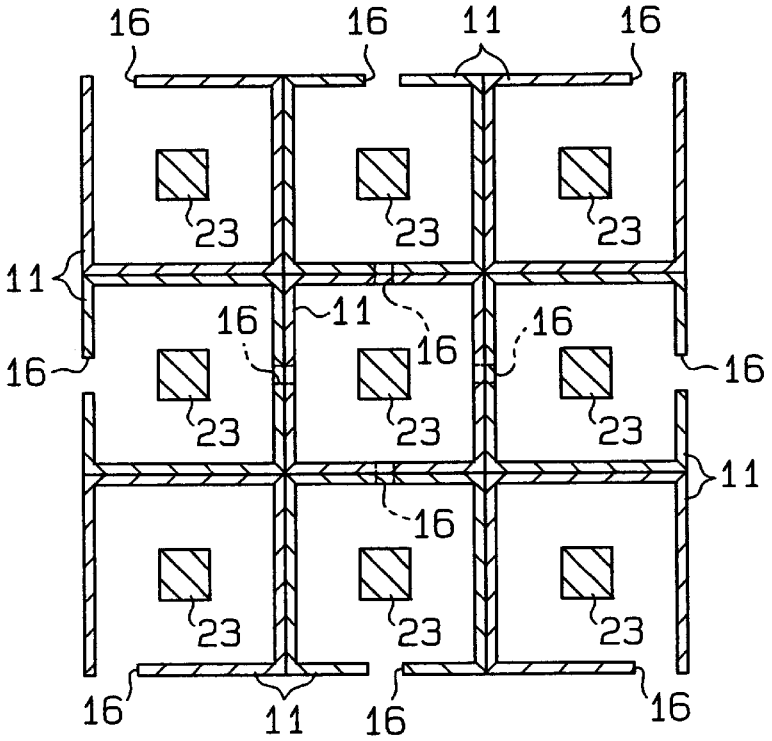
FIG. 3 is a cross section of a modified form of the rectangular pipes in the first embodiment.

As shown in FIG. 3, in the first embodiment, the slits 16 are formed in the rectangular pipes 11 in the corners of the pipe assembly, but the slits 16 may additionally be formed in other rectangular pipes facing outside of the pipe assembly. In such a case, except for one rectangular pipe 11 located in the center, the other eight rectangular pipes 11 may communicate with the guide passage 14. Accordingly, the air cleaned within the rectangular pipes 11 can be effectively returned into the inlet chamber 4.

As shown in FIG. 3, the slits 16 illustrated with a broken line may also be formed between the centrally located rectangular pipe 11 and each of four rectangular pipes 11 adjacent to the centrally located rectangular pipe 11. In such case, the air cleaned within the rectangular pipes 11 can be more effectively returned into the inlet chamber 4. Therefore, the amount of air flowing from the guide passage 14 into the inlet chamber 4 is increased to further reduce the content of the mist and the like in the air so that the mist and the like can be more positively removed from the air.

Instead of forming the slit 16 in each rectangular pipe 11 as in the first embodiment, a plurality of through holes communicating with the guide passage 14 can be formed along a length of the rectangular pipe 11.

In the second embodiment, the inner bottom walls can be modified to extend horizontally.

Instead of forming the slit 46 and 46*a* in each rectangular pipe 41 as in the second embodiment, a plurality of through holes can be formed along a length of the pipe 41.

Figure 7:
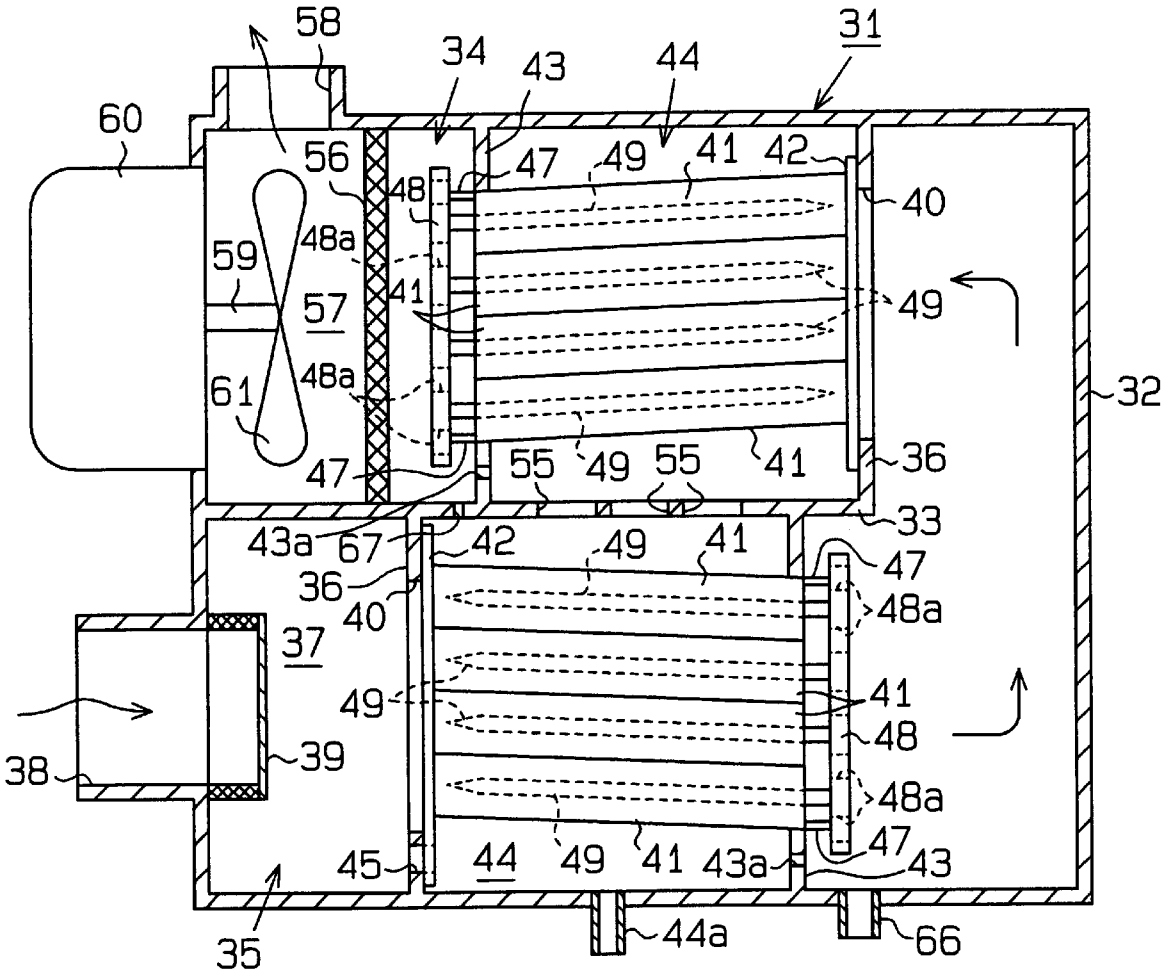
FIG. 7 is a vertical section of a modified form of the rectangular pipes in the second embodiment.

As shown in FIG. 7, the rectangular pipes 41 and the electrode pins 49 disclosed in the second embodiment may extend downward in an oblique manner toward downstream of the air flow. A discharge port 66 may be formed at the bottom of the housing 32 on the right side of the collar 43 in the lower passage 35. A discharge opening 67 may extend through the partition 33 on the left side of the collar 43 of the upper passage 34 to communicate with the guide passage 44 of the lower passage 35. In this arrangement, the droplets in each rectangular pipe 41 flow toward the slit 46 and also along the length of the rectangular pipe 41. As a result, the traveling distance of each droplet along the inner wall of the rectangular pipe 41 is lengthened. This may promote coalescence of the droplets and increase the moving speed of each droplet along the inner wall of each rectangular pipe 41 to effectively drain off the droplets out of the rectangular pipe 41. The droplets dropped from the open end of each rectangular pipe 41 of the lower passage 35 adjacent to the anode plate 48, rather than from the slits 46 and 46*a*, may be drained off from the discharge port 66 to the outside. Also, the droplets dropped from the open end of each rectangular pipe 41 of the upper passage 34 adjacent to the anode 48, rather than from slits 46 and 46*a*, will be drained off from the discharge port 44*a* to the outside through the discharge opening 67 and the guide passage 44 of the lower passage 35.

In the above embodiments, the number of the rectangular pipes 11 and 41 may be changed as appropriate.

Also, in the above embodiments, even though the rectangular pipes 11 and 41 are used as the dust collection electrodes, the pipes 11 and 41 can be formed in other polygonal shapes such as a triangular or hexagonal shape. In addition, the pipes 11 and 41 may be cylindrical rather than rectangular.

In the above embodiments, the rectangular pipes 11 and 41 are arrayed one above the other to provide a lattice-like pipe assembly. Alternatively, there may be provided a single lattice-like rectangular pipe.

Additionally, the pipes 11 and 41 may be positively (+) charged while the electrode pins 23 and 49 are negatively (−) charged. This arrangement may provide the same effect as that of the arrangements shown in the above embodiments.

We claim:

1. An electrostatic precipitator for removing fine particles from gas, comprising:

an inlet chamber for receiving gas containing fine particles;

at least one discharge electrode;

a dust collection electrode substantially surrounding each discharge electrode such that an air space is defined between the dust collection electrode and its associated discharge electrode, the dust collection electrode having a wall, an entrance opening and an exit slit, said exit slit being formed in said wall to communicate said air space with a guide passage such that gas is permitted to flow into said air space through said entrance opening from the inlet chamber, and out of said air space through said exit slit;

voltage means connected to each pair of dust collection electrode and associated discharge electrode for applying a voltage between the discharge electrode and the dust collection electrode to create an electric field therebetween for electrostatically collecting fine particles from the gas in said air space on the dust collection electrode; and said guide passage to route gas that has had fine particles removed from it by the electric field back to the inlet chamber thereby reducing the density of fine particles in the air, the air with the reduced density of fine particles then mixing with air newly introduced from said inlet chamber and together flowing through said entrance opening.

2. An electrostatic precipitator according to claim 1, wherein each dust collection electrode and its associated discharge electrode are elongated and longitudinally coaxial.

3. An electrostatic precipitator according to claim 1, further comprising:

an outlet chamber;

at least one relief opening between said guide passage and said outlet chamber for communicating said guide passage with said outlet chamber; and at least one guide opening between said guide passage and said inlet chamber for communicating said guide passage with said inlet chamber; wherein, said outlet chamber communicating with said guide passage such that gas exiting each dust collection electrode through said exit slit at least partly flows into said outlet chamber; and the area of said relief openings is smaller than that of said guide openings.

4. An electrostatic precipitator according to claim 1, wherein a plurality of dust collection electrodes are arranged in an array to form a unitary assembly, the unitary assembly having an outer wall formed by said plurality of dust collecting electrodes, and wherein a plurality of said exit slits are formed in said outer wall to communicate said air spaces of said dust collection electrodes with said guide passage to supply said guide passage with the gas that has had particles removed from it.

5. An electrostatic precipitator according to claim 4, wherein said unitary assembly has an internal dust collection electrode that is surrounded by external dust collection electrodes, wherein said external dust collection electrodes have walls forming the outer wall of said unitary assembly, and wherein said internal dust collection electrode has a wall and wherein an opening is formed in its wall that communicates said air space of said internal dust collection electrode with said air space of at least one of said external dust collection electrodes.

* * * * *